US005975946A

United States Patent [19]

Watanabe

[11] Patent Number: 5,975,946

[45] Date of Patent: Nov. 2, 1999

[54] CONNECTOR COUPLING STRUCTURE

[75] Inventor: Hiroshi Watanabe, Shizouka, Japan

[73] Assignee: Yazaki Corporation, Tokyo, Japan

[21] Appl. No.: 09/160,034

[22] Filed: Sep. 25, 1998

[30] Foreign Application Priority Data

Sep. 26, 1997 [JP] Japan ..... 9-261966

[51] Int. Cl.[6] ..... H01R 33/945

[52] U.S. Cl. ..... 439/557

[58] Field of Search ..... 439/553, 630, 439/248, 329

[56] References Cited

U.S. PATENT DOCUMENTS

| | | | |
|---|---|---|---|
| 4,113,342 | 9/1978 | Andreaggi | 339/176 |
| 4,871,315 | 10/1989 | Noschese | 439/67 |
| 5,173,061 | 12/1992 | Comerci et al. | 439/536 |
| 5,354,216 | 10/1994 | Cruise et al. | 439/553 |
| 5,489,216 | 2/1996 | Matshushita et al. | 439/260 |

FOREIGN PATENT DOCUMENTS

| | | |
|---|---|---|
| 6-65092 | 8/1994 | Japan . |
| 8-37065 | 2/1996 | Japan . |

*Primary Examiner*—Paula Bradley
*Assistant Examiner*—Truc T. Nguyen
*Attorney, Agent, or Firm*—Armstrong, Westerman, Hattori, McLeland & Naughton

[57] ABSTRACT

A connector A has a plurality of connector chambers 32 of a connector housing 31. A plurality of terminals 3 each having an elastic contact piece 3*a* are accommodated in the connector chambers, respectively, and exposed from the upper face of the connector housing. A connector holding component B constitutes an L-shape composed of a first face and a second face. The connector A is inserted into a connector holding component B through an opening formed in the face so that the lower face of the connector housing 31 is opposite to the second face of the connector holding component B. Between the connector A and the second face of the connector holding component B, a connector contact spring 40 is placed which serves as an elastic member compressible in a direction Q perpendicular to the direction P of inserting the connector A. An auxiliary device C provided with a printed board 10 having connection terminal strips 10*a* is pushed toward the connector A in a direction Q. Thus, coupling between the printed board 10 and connector A can be made by small force so that the elastic contact pieces 3*a* and connector terminal strips 10*a* can be prevented from being damaged or deformed.

7 Claims, 13 Drawing Sheets

CONNECTOR COUPLING STRUCTURE

BACKGROUND OF THE INVENTION

1. Field of the Invention

The present invention relates to a connector coupling structure in which an elastic contact piece of a terminal is exposed from a terminal chamber in a state where the terminal is fit into the terminal chamber of a connector, and more particularly to a connector coupling structure between the elastic contact piece of the terminal and a printed board with a terminal connection strip corresponding to the elastic contact piece.

2. Description of the Prior Art

Conventionally, a first proposal of making connector coupling has been made by catching the above connector into an edge of a printed board. A second proposal of making connector coupling has been made by inserting the connector into an accommodating space of another connector. Such a connector coupling is formed mainly on a printed board attached to a switching unit provided on a meter or door trim panel of a motor vehicle.

The first proposal is disclosed in JP-A-37065. FIG. 13 is an exploded perspective view of a connector. FIGS. 14–16 are sectional views showing the process of coupling the connector at issue with another connector.

As shown in FIG. 13, a connector, generally 1, includes two flat-box shaped inner housings 4, each with a plurality of metal fittings 3 having elastic contact pieces 3*a*, respectively, within a box-shaped outer housing 2 with a rear face opened.

On each of the inner side walls of the outer housing 2, a pair of rotary shafts 5 are provided, and on each of the outer side walls of the inner housings 4, a pair of tube-like receivers 6 are formed. The shaft receiver 6 has a recess 6*a* on a side of inserting the inner housings 4 into the outer housing 2.

When the inner housings 4 are inserted into the outer housing 2, the recesses 6*a* are pushed in the rotary shafts 5. Each of spring members 7 is also hung over one of a pair of holding pieces opposite to each other on the inner walls of the outer housing 2 and spring receivers 9 formed on the outer side walls of the inner housings. Thus, the inner housings 4 are rotatably held within the outer housing 2 (see FIG. 14).

The spring members 7 urge the inner housings 4 so that the corresponding elastic contact pieces 3*a* of the terminals 3 become apart from each other. Thus, when the connector 1 starts to be coupled with the printed board of another connector, the elastic contact pieces 3*a* of the terminals 3 are brought into slight contact with the terminal connection strips formed on the printed board 10 (FIG. 15). As shown in FIG. 16, when the connector 1 is further pushed in another connector, introducing cams 12, formed on the inner upper and lower walls of a hood 11 surrounding the printed board 10, rotate the inner housings 4 towards the printed board 10 against the urging force of each of the spring members 7. At the same time, the elastic contact pieces 3*a* of the terminal connection pieces 10*a* (FIG. 13) slid while being pressed. Thus, coupling of the connector 1 with another connector is completed.

On the other hand, the above second proposal of making connector coupling is disclosed in Japanese Patent Publn. No. 6-65,092. FIG. 17 is an exploded perspective view of a connector a part of which is broken. FIG. 18 is a longitudinal sectional view of FIG. 17. FIG. 19 is an exploded perspective view of an exploded perspective view of a connector and another connector.

In FIGS. 17–19, reference numeral 13 denotes a connector, 14 a protection cover for opening/closing the exposed portion of a terminal of the connector 13, 15 another connector used for the above meter, switch unit, etc., and 16 a wire harness to be connected to each of terminals in the connector 13. In FIGS. 17–19, like reference numerals refer to like elements in FIGS. 13–16.

Within a connector housing 17 of the connector 13, a plurality of terminal chambers 18 are arranged in parallel. With the terminal 3 inserted into the terminal chamber 18, its elastic contact piece 3*a* is exposed from an opening portion 18*a* of the terminal chamber 18. In the vicinity of the terminal chambers 18, spaces 19 for detection are formed between the terminal chambers 18 and the a bottom plate 20, respectively. The terminal chamber 18 has a recess 18*c* at its bottom wall, which communicates with the space 19 for detection. At the recess 18*c*, a flexible engagement piece 21 is extended from the peripheral wall 18*d* of the terminal chamber 18. The flexible engagement piece 21 has an engagement tip 21*a*.

On both side walls 22 (only one is shown) of the connector housing 17, a groove 22*a* for sliding the protection cover 14 is formed. The side wall 22 has an engagement protrusion 22*b* in the vicinity of the inlet of the groove 22*a*. The side wall 22 has a slit 22*c* formed in its longitudinal direction. Further, within the connector housing 17, a passage 23 is formed which crosses substantially perpendicularly to the face where the protection cover 14 is opened/closed and communicates with the space 19 for detection. In the vicinity of the inlet of the passage 23, an engagement protrusion 23*a* is protruded from the connector housing 17.

The protection cover 14 includes a cover body 14*a* and a detection member 14*b* which are coupled with each other through a coupling member 14*c*. The protection cover 14 is attached to the connector housing 17 in such a fashion that both ends of the cover body 14*a* are inserted into the grooves 22*a*, the detection member 14*b* is inserted into the space 19, and the coupling member 14*c* is inserted into the communicating passage 23.

The other connector 15 includes a space 24 for accommodating the connector 13 and a printed board 10 affixed on the upper face. The printed board 10 is to be brought into contact with the elastic contact pieces 3*a* of the terminals 3 along the space 24. A protrusion 24*a* is provided uprightly on the bottom of the space 24 in a direction of fitting the connector 13 in the space. The protrusion 24*a* is to be brought into contact with the detecting member 14*b* of the protecting cover 14.

When the fitting terminal of the connector 13 is inserted in the accommodating space 24 of the other connector 15, while the protrusion 24*a* is pressed against the detecting member 14*b*, the coupling member 14*c* travels in the communicating passage 23. Thus, the protection cover 14 moves in an opening direction to open the exposed face of the elastic contact piece 3*a* of the terminal 3. Then, the connector 13 is fit into the accommodating space 24 of the other connector 15 so that while the elastic contact pieces 3*a* slide, they are brought into contact with the terminal connection strips 10*a* formed on the printed board 10 to make electrical connection therebetween.

The prior arts described above has the following disadvantage. Since the elastic contact pieces 3*a* of the terminals 3 are brought into electric contact with the terminal connection strips 10*a* in a sliding manner, the force required for connector coupling cannot be reduced so greatly so that the workability remains poor. Some manners of connector coupling may generate deformation or damage of the elastic contact pieces 3*a* and the terminal connection strips 10*a*.

SUMMARY OF THE INVENTION

An object of the present invention is to provide a connector coupling structure which can realize coupling of a connector with a printed board by small force and prevent an elastic contact piece and a terminal connection strip from being deformed and damaged.

In order to attain the above object, there is provided a connector coupling structure comprising: a connector for a wire harness including a connector housing having an upper and a lower face and a plurality of terminal chambers, and a plurality of terminals equipped with elastic contact pieces, respectively, the elastic contact pieces being exposed from the upper face of the connector housing, respectively; a printed board having a plurality of terminal connection strips formed on its surface and to be connected to the elastic contact pieces, respectively; a connector holding component constituting an L-shape composed of a first face and a second face, the first face thereof having an opening for inserting said connector and the second face thereof being opposite to the lower face of said connector housing when said connector is inserted into the said connector holding component; and an elastic member arranged between the lower face of the connector housing and the second face of the connector holding component when the connector is inserted in the connector holding component, the elastic member being compressible in a direction perpendicular to a direction of inserting the connector in the connector holding component and a longitudinal direction of the second face of the connector holding component, wherein the printed board is pressed against the connector so that the elastic contact pieces are coupled with the terminal connection strips.

In this configuration, since the printed board is coupled with the connector by not mutual sliding force therebetween, but small pressing force for the connector, thus improving the workability of connector coupling. In addition, the elastic contact pieces and the terminal connection strips can prevented from being deformed and damaged.

The above and other objects and features of the present invention will be more apparent from the following description taken in conjunction with the accompanying drawings.

DESCRIPTION OF THE PREFERRED EMBODIMENTS

Embodiment 1

Figure 1:
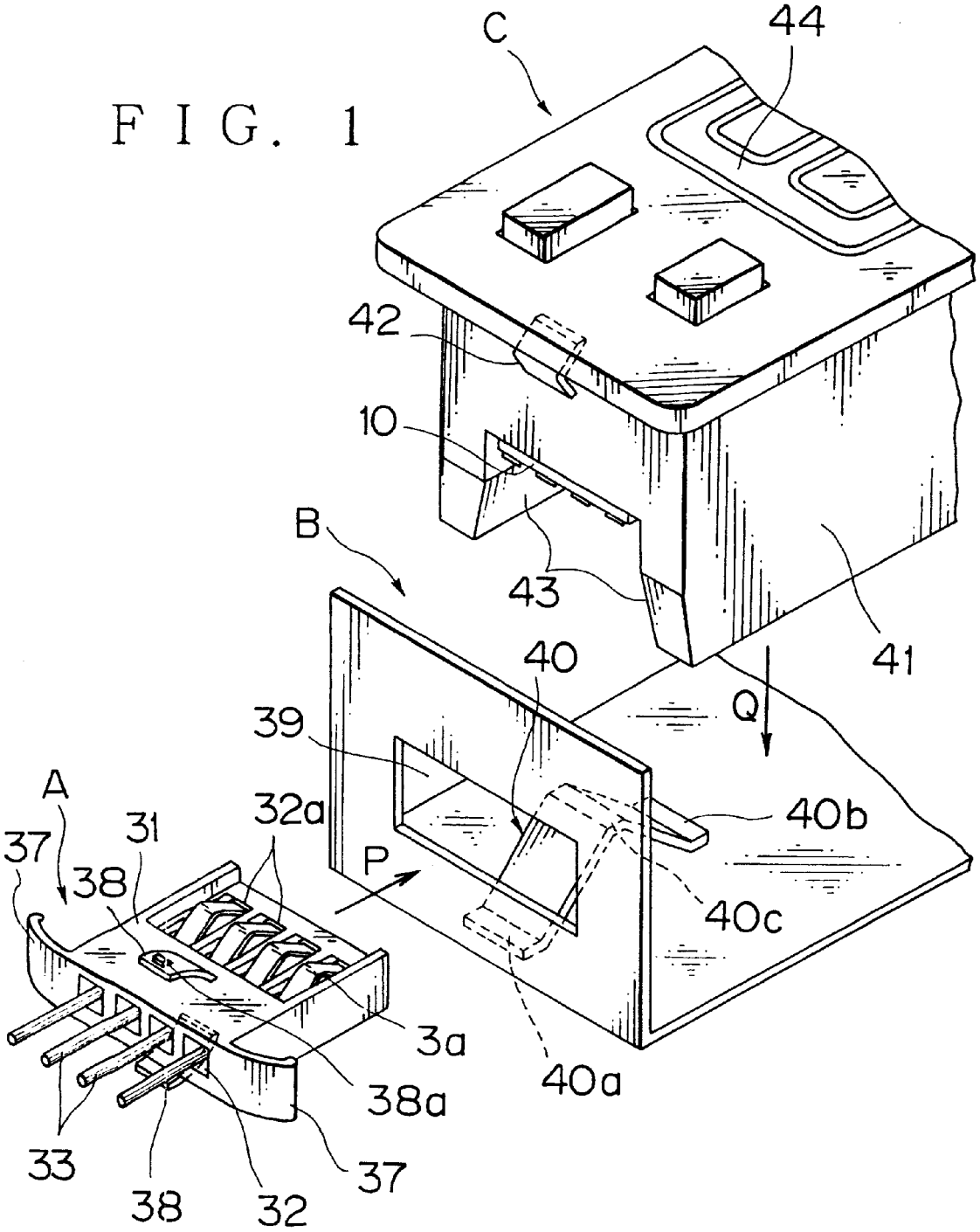
FIG. 1 is a perspective view showing an embodiment of the connector coupling structure of the present invention.
Figure 2:
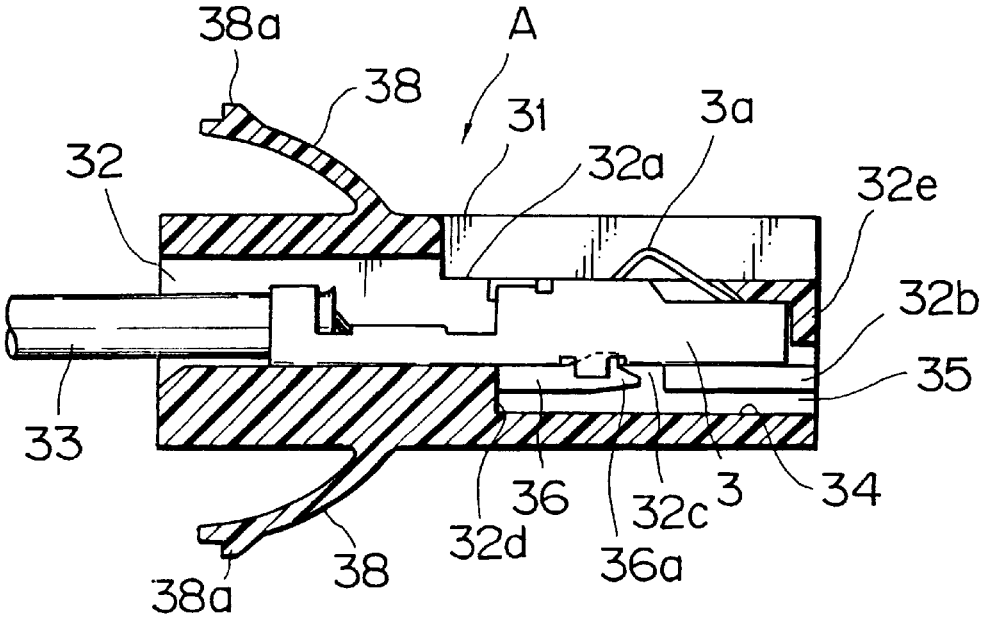
FIG. 2 is a sectional view of a connector in FIG. 1.
Figure 3:
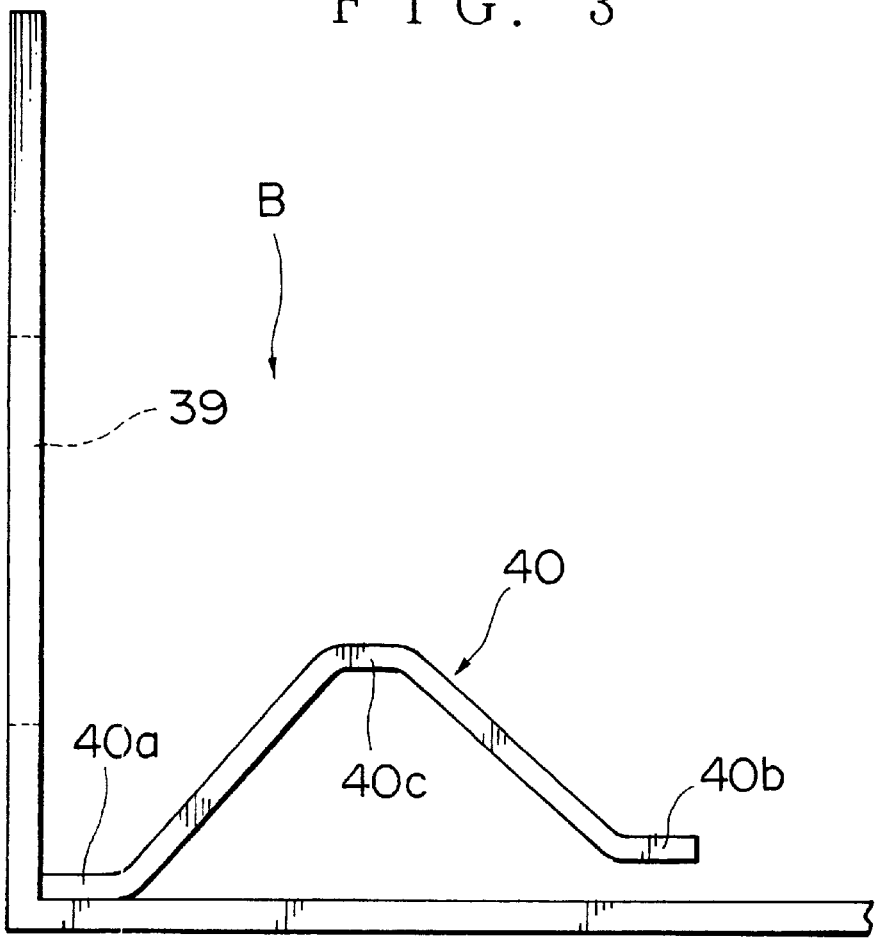
FIG. 3 is a side view of a connector holding component in FIG. 1.

Now referring to the drawings, an explanation will be given of a first embodiment of the connector coupling structure according to the present invention. FIG. 1 is a perspective view showing an embodiment of the connector coupling structure of the present invention; FIG. 2 is a sectional view of a connector in FIG. 1; FIG. 3 is a side view of a connector holding component in FIG. 1.

In FIG. 1, element A denotes a connector; element B denotes a connector holding component into which the connector A is to be inserted; element C denotes an auxiliary device such as a switch unit or combination meter provided on a door trim panel.

Also referring to FIG. 2, within a connector housing 31 of synthetic resin of the connector A, a plurality of terminal chambers 32 are arranged in parallel. The terminal chamber 32 has an opening area 2*a*. When the terminal 3 connected to an electric wire 33 and having an elastic contact piece 3*a* is fit into the terminal chamber 32, the elastic contact piece 3*a* is exposed form the opening area 32*a*. A space 35 is formed between the terminal chambers 32 and a bottom plate 34. The terminal chamber 32 has a recess 32*c* at its bottom wall, which communicates with the space 35. In the recess 32*c*, a flexible engagement piece 36 is extended from the peripheral wall 32*d* of the terminal chamber 18. The terminal chamber 32 has a front wall 32*e* serving as a stopper for the terminal 3. The flexible engagement piece 36 has a terminal securing portion 36*a* formed at its tip.

The connector housing 31 is provided with a pair of opposite securing pieces 37 on both sides of the rear face. The connector housing 31 is provided with a pair of opposite flexible securing pieces 38 attached centrally to its upper and lower surfaces. Each securing piece 38 has a tip extending rearward. The securing piece 37 is slightly flexible and warped. Each securing piece 38 has a securing area 38*a* for the connector holding component B.

The connector holding component B, as seen from FIGS. 1 and 3, is a frame or box having faces constituting an L-shape. The one face of the L-shape in a vertical direction has a square opening 39 for inserting the connector A. The other face of the L-shape in a horizontal direction is provided with an elastic connector contact spring 40 made of a metallic plate.

The connector contact spring 40 is entirely bent in a -shape and has both ends 40*a* and 40*b* bent in parallel to the other face of the above L-shape. The one end 40*a* is attached to the vicinity of the corner of the L-shape. The other end 40*b* is slightly floats from the other face. When force is applied to a bending portion 40*c* of the connector contact spring 40 from above, the other end 40*b* warps to move away from the one face. Incidentally, the connector contact spring may be formed of a plate of synthetic resin in place of the metallic plate in this embodiment. Further, instead of using the plate spring, a compressive coil spring may be provided on the other face.

Figure 13:
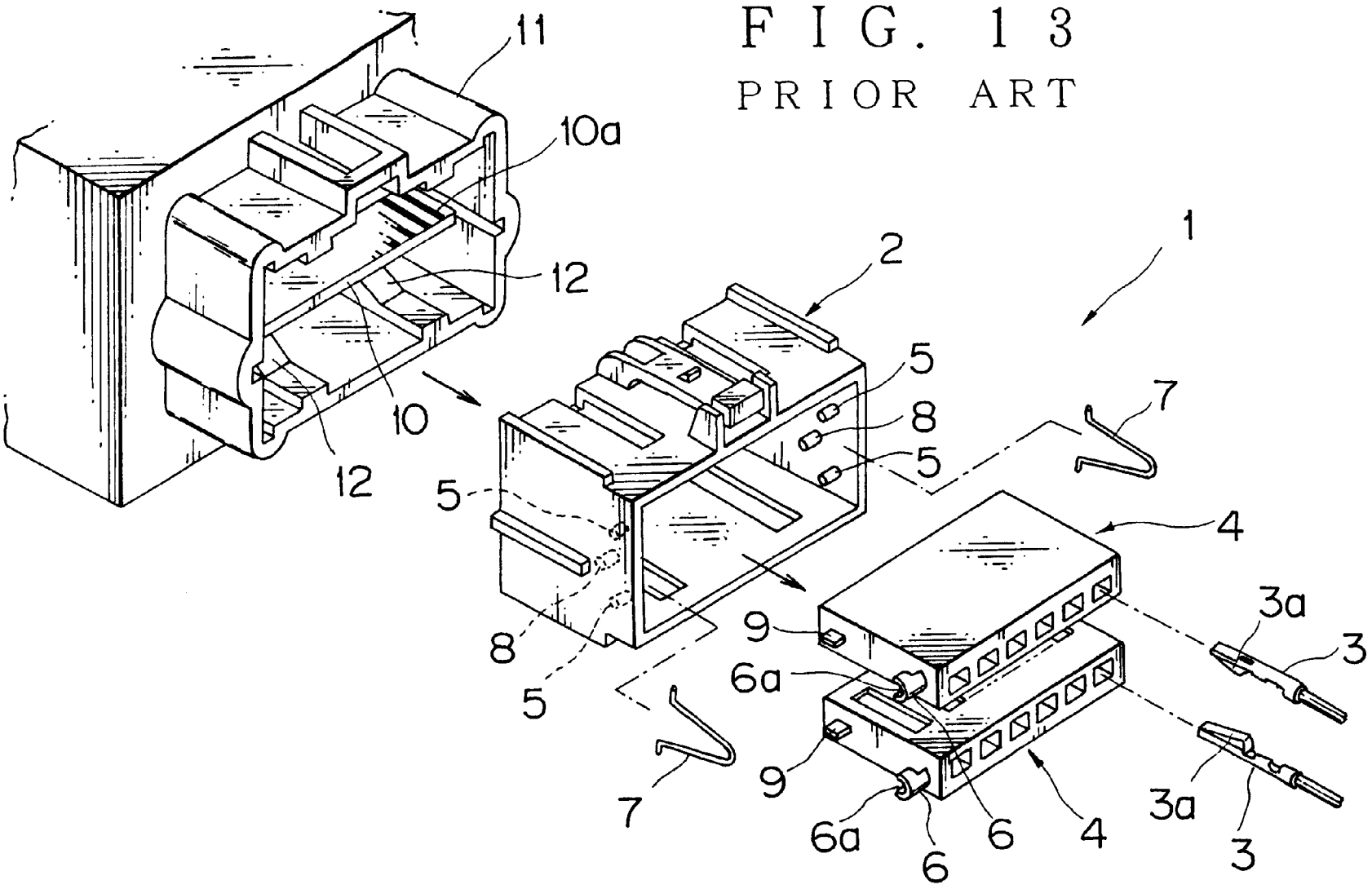
FIG. 13 PRIOR ART
FIG. 13 is a perspective view of a conventional connector coupling structure.
Figure 14:
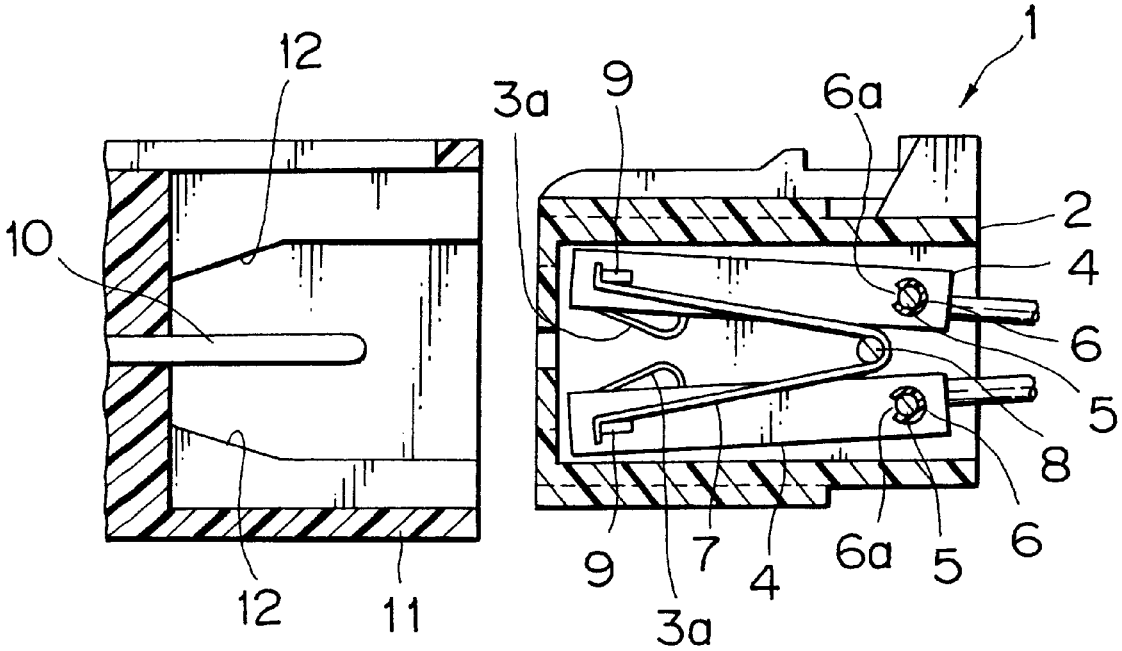
FIG. 14 PRIOR ART
FIG. 14 is a sectional view showing the state immediately before the connector of FIG. 13 is coupled with another connector.
Figure 15:
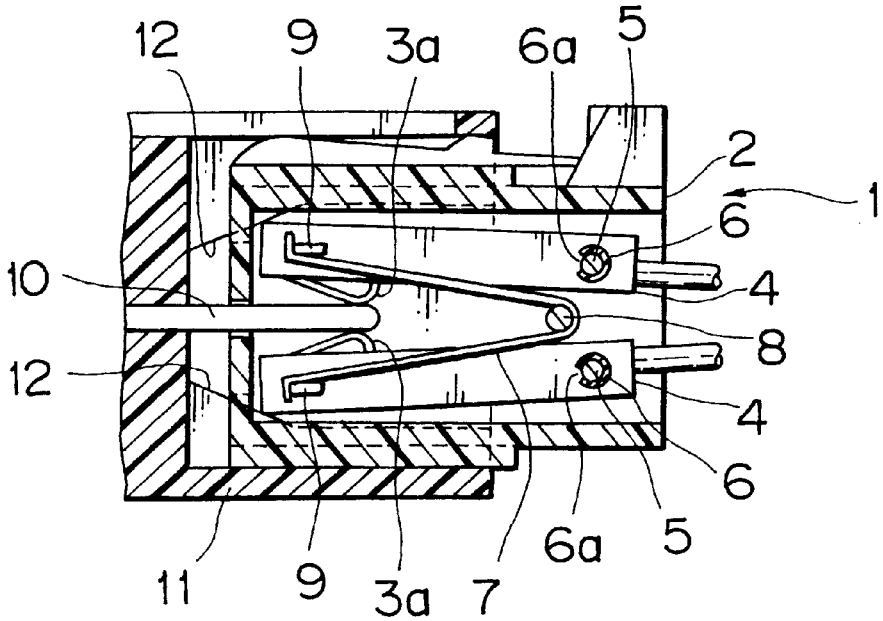
FIG. 15 PRIOR ART
FIG. 15 is a sectional view showing the state where the connector of FIG. 13 is coupled with another connector so that the elastic contact piece is brought into contact with the terminal connection strip on the printed board.
Figure 16:
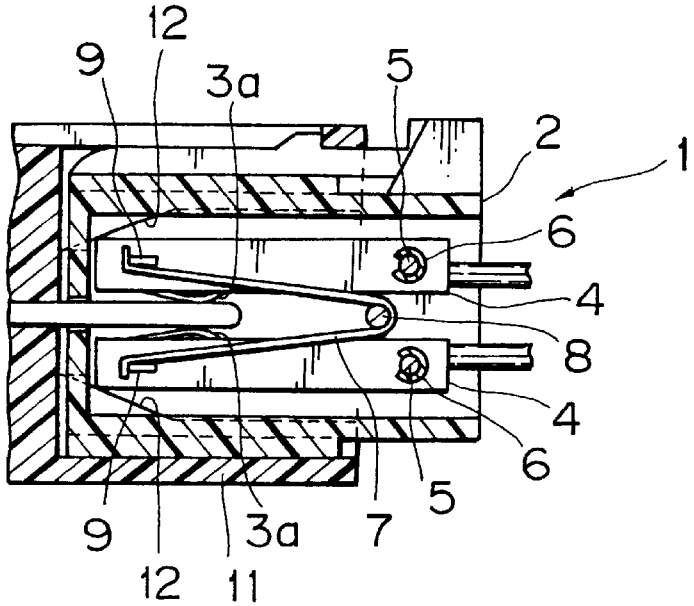
FIG. 16 PRIOR ART
FIG. 16 is a sectional view showing the state where coupling between the connector of FIG. 13 and another connector has been completed.
Figure 17:
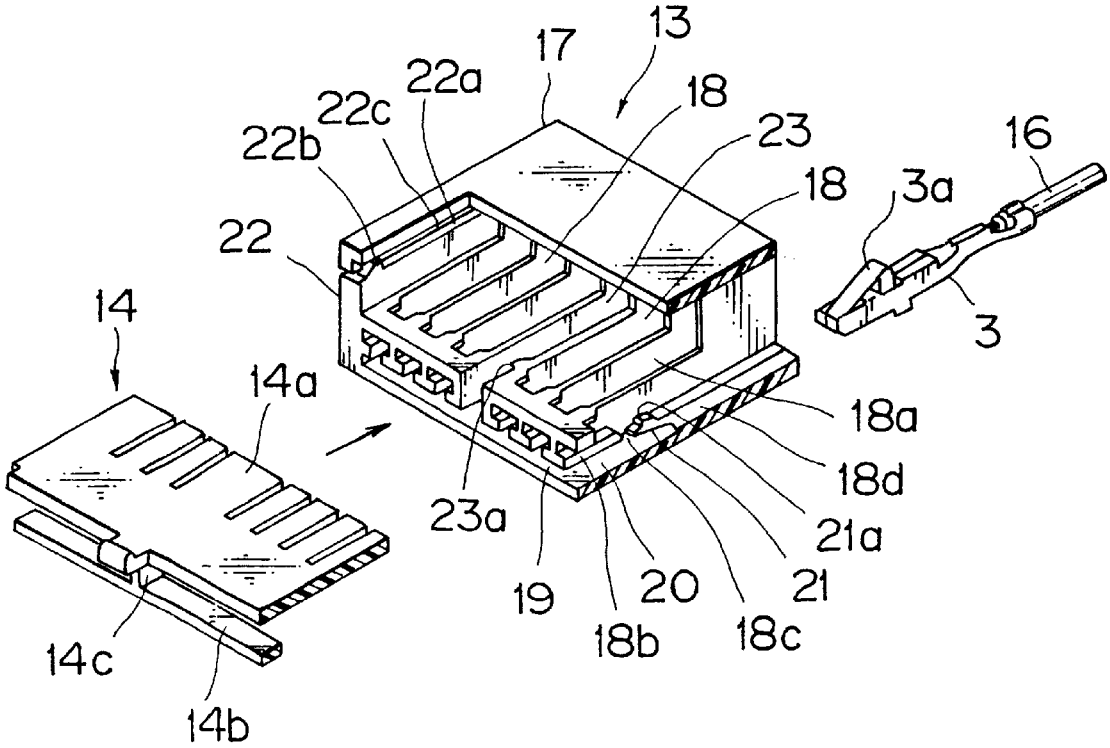
FIG. 17 PRIOR ART
FIG. 17 is a perspective view showing another coupling structure of a conventional connector.
Figure 18:
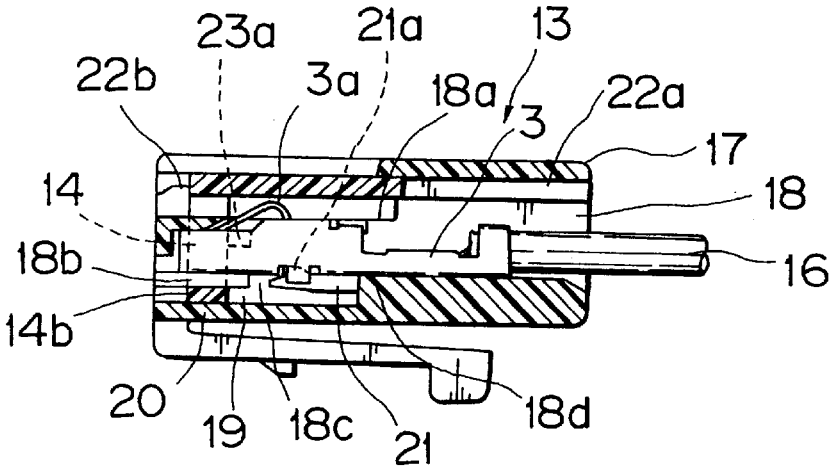
FIG. 18 PRIOR ART
FIG. 18 is a sectional view of the connector of FIG. 17.
Figure 19:
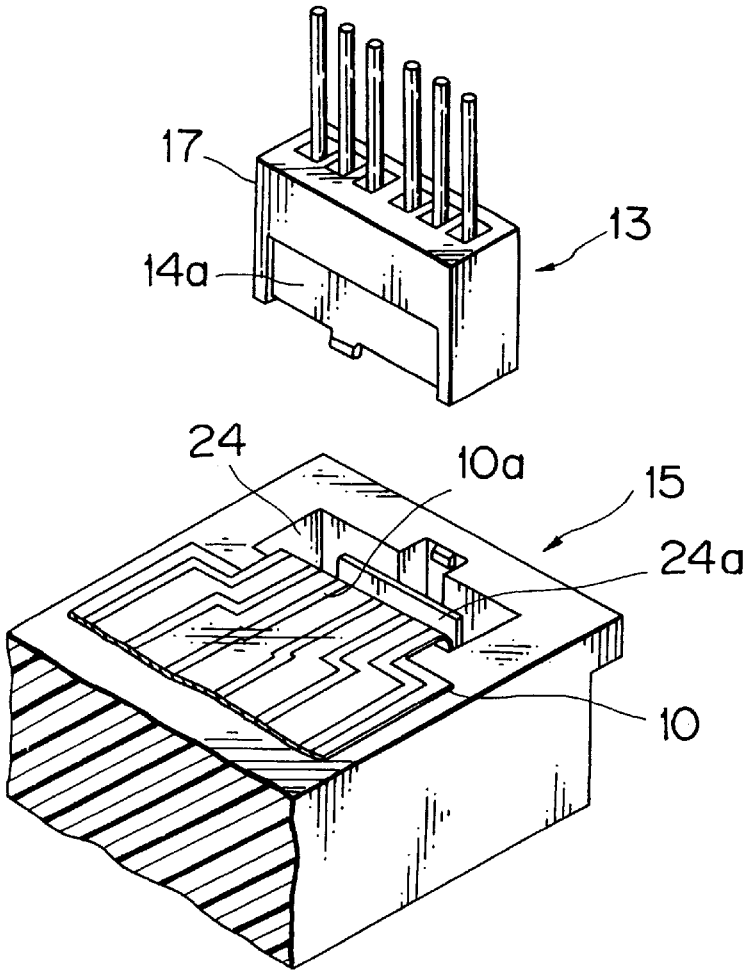
FIG. 19 PRIOR ART
FIG. 19 is a perspective view showing the state where the connector of FIG. 17 is to be coupled with another connector.

The auxiliary device C shown in FIG. 1 is a switch unit provided on a door trim panel (not shown). A case 41 of the switch unit is provided, on its lower side, with a printed board 10 for making an electric connection to the auxiliary device C. The printed board 10 has a plurality of terminal connection strips 10*a* formed on the surface thereof and corresponding to the elastic contact pieces 3*a* of the connector A (see FIG. 13). The case 41 is provided with a locking member 42 for locking the door trim panel and has tapered areas 43 on both sides of the printed board 10. The tapered areas are formed for alignment of the auxiliary device C with the connector A. The case 41 is provided, on its upper surface, several kinds of switches 44 of a driving motor for the door mirror and power window.

Now referring to FIGS. 4–7, an explanation will be given of electric connection, in the above configuration, between each of the elastic contact pieces 3*a* of the connector A and the terminal connection strips of the auxiliary device C.

Figure 4:
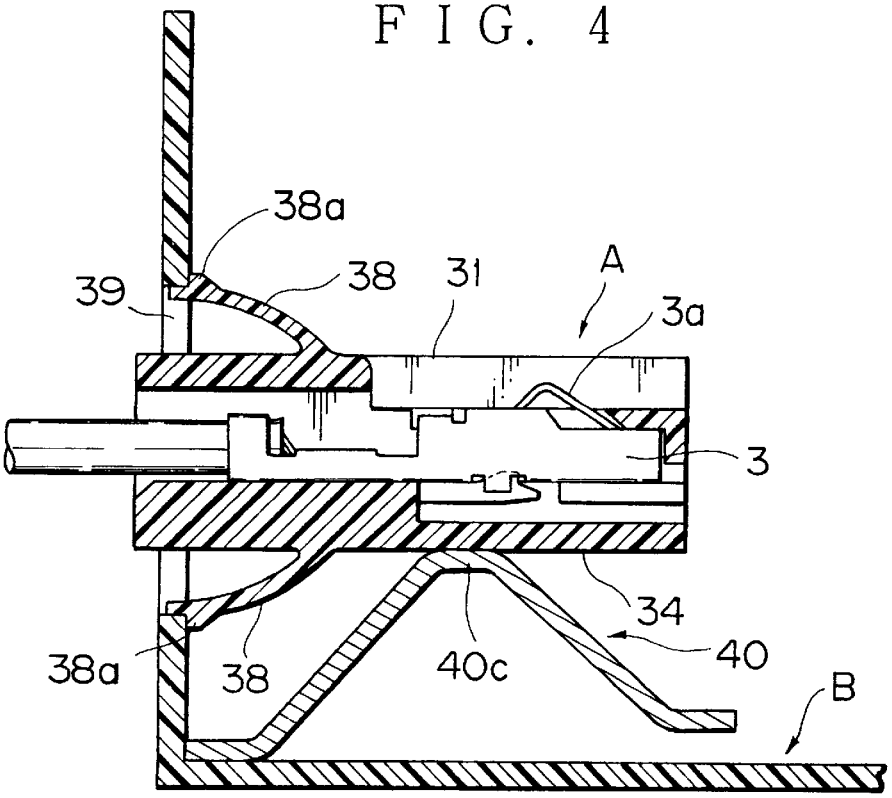
FIG. 4 is a sectional view showing the state where the connector has been inserted into the connector holding component.

First, as seen from FIG. 4, with the elastic contact piece 3*a* of each terminal 3 located upwardly, the connector A is inserted into the connector holding component B in a direction of arrow P in FIG. 1. When the connector A is inserted in the connector insertion opening 39, the pair of securing pieces (stoppers) 37 (FIG. 1) are brought into contact with the one face of the connector holding component B, the securing areas 38*a* of the securing pieces 38 are engaged with the opening 39, and the bottom plate 34 is placed on the bending portion 40*c* of the connector contact spring 40.

Figure 5:
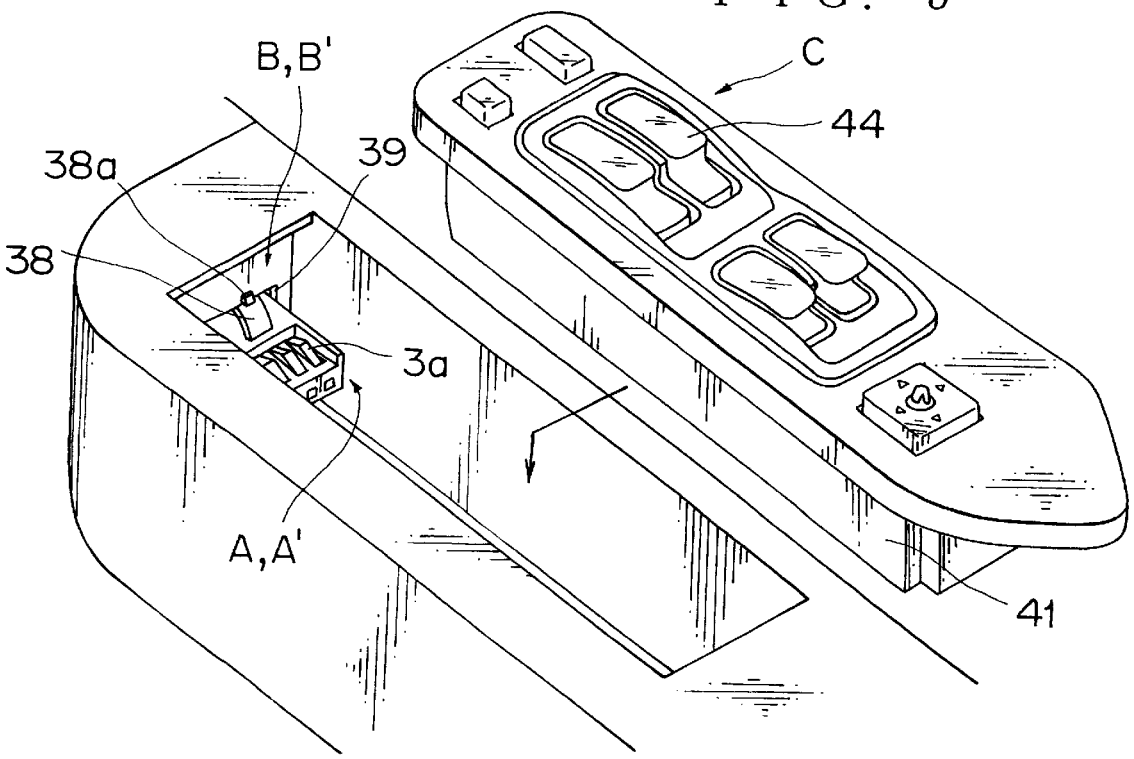
FIG. 5 is a perspective view showing the state where an auxiliary device is about to be attached to the connector inserted in the connector holding component.

In this state, movement of the connector A is limited in a direction of moving the connector A in/from the connector holding component B so that as shown in FIG. 5, the connector A is firmly mounted on the door trim panel.

Figure 6:
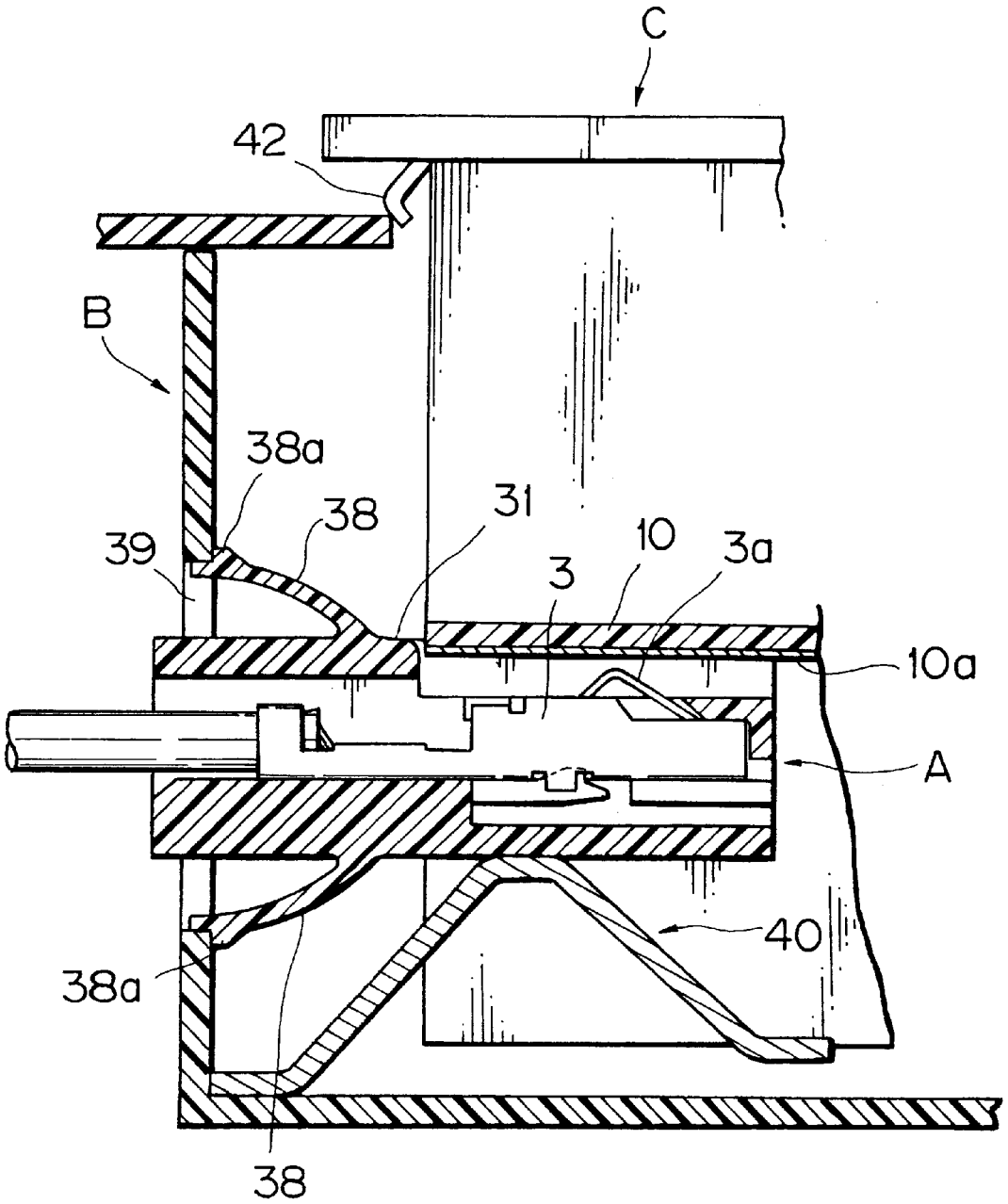
FIG. 6 is a sectional view for explaining the state of the elastic contact piece and terminal connecting area of a printed board immediately before the auxiliary device is mounted in the connector holding component.

When the auxiliary device C is pushed into the door trim panel in a direction of arrow Q in FIG. 1, as seen from FIG. 6, the locking member 42 is brought into contact with the edge of the door trim panel and the printed board 10 opposes to the elastic contact pieces 3*a* spaced apart therefrom. The printed board 10 may be brought into slight contact with the elastic contact piece 3*a*. Further, the connector A is moved horizontally with respect to the direction of arrow P using the tapered areas 43 of the auxiliary device C so that precise alignment can be made between the connector A and the printed board 10.

Figure 7:
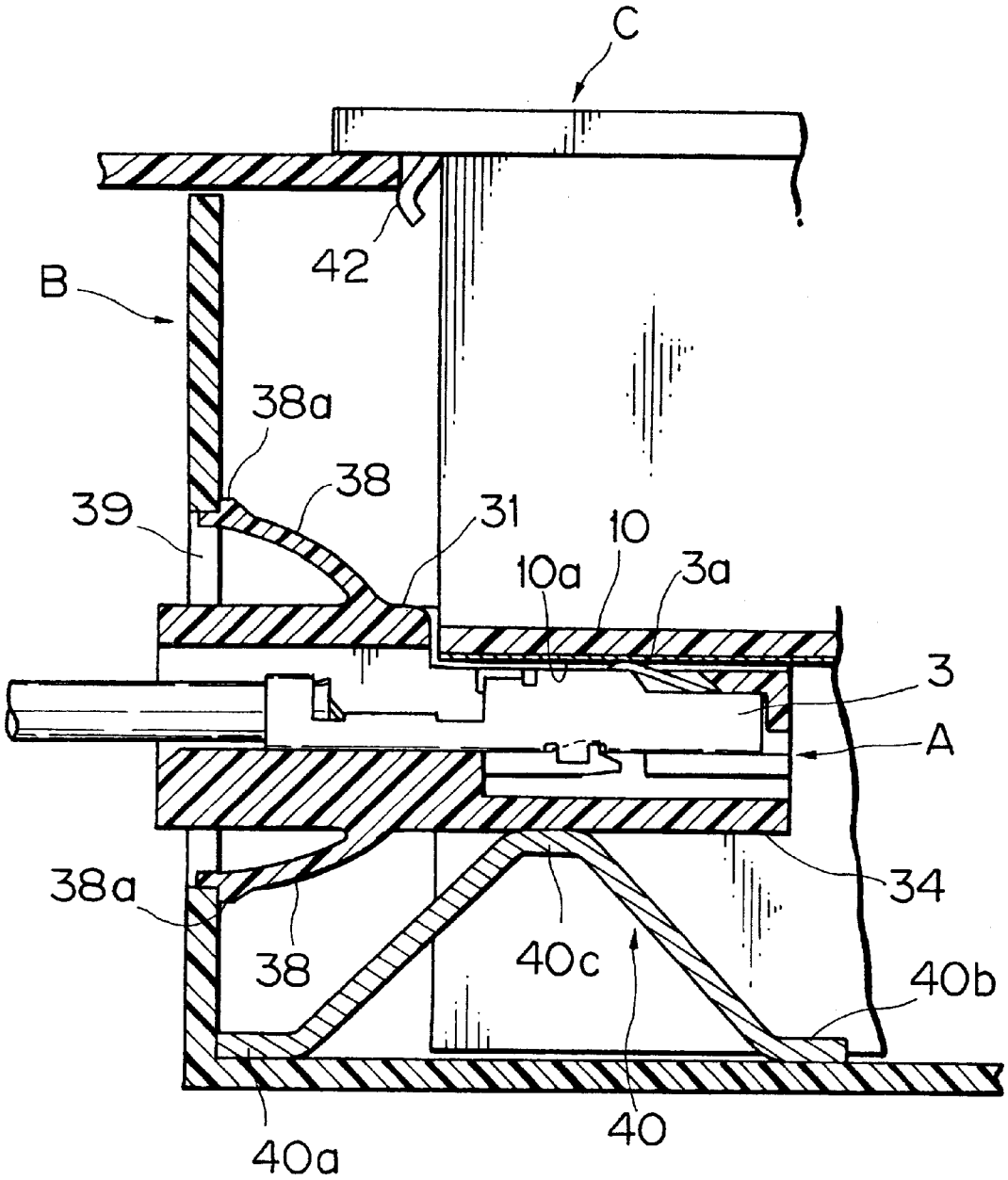
FIG. 7 is a sectional view showing the coupling state between the elastic contact piece of the terminal and terminal connection strip on the printed board.

When the auxiliary device C is further pushed into the connector holding component B, the locking member 42 is pressed against the edge of the door trim panel, and warps inwardly so that the auxiliary device C is secured on the door trim panel (see FIG. 7). Then, the force applied to mount the auxiliary device pushes the connector A downwards so that the connector A moves downward by an amount of engagement of the locking member 42 together with the connector contact spring 40. The connector contact spring 40 intends to push up the connector A by its elastic force. Thus, the elastic contact piece 3*a* and the corresponding terminal connection strip 10*a* of the printed board 10 are electrically connected to each other in a stable state.

Embodiment 2

Figure 8:
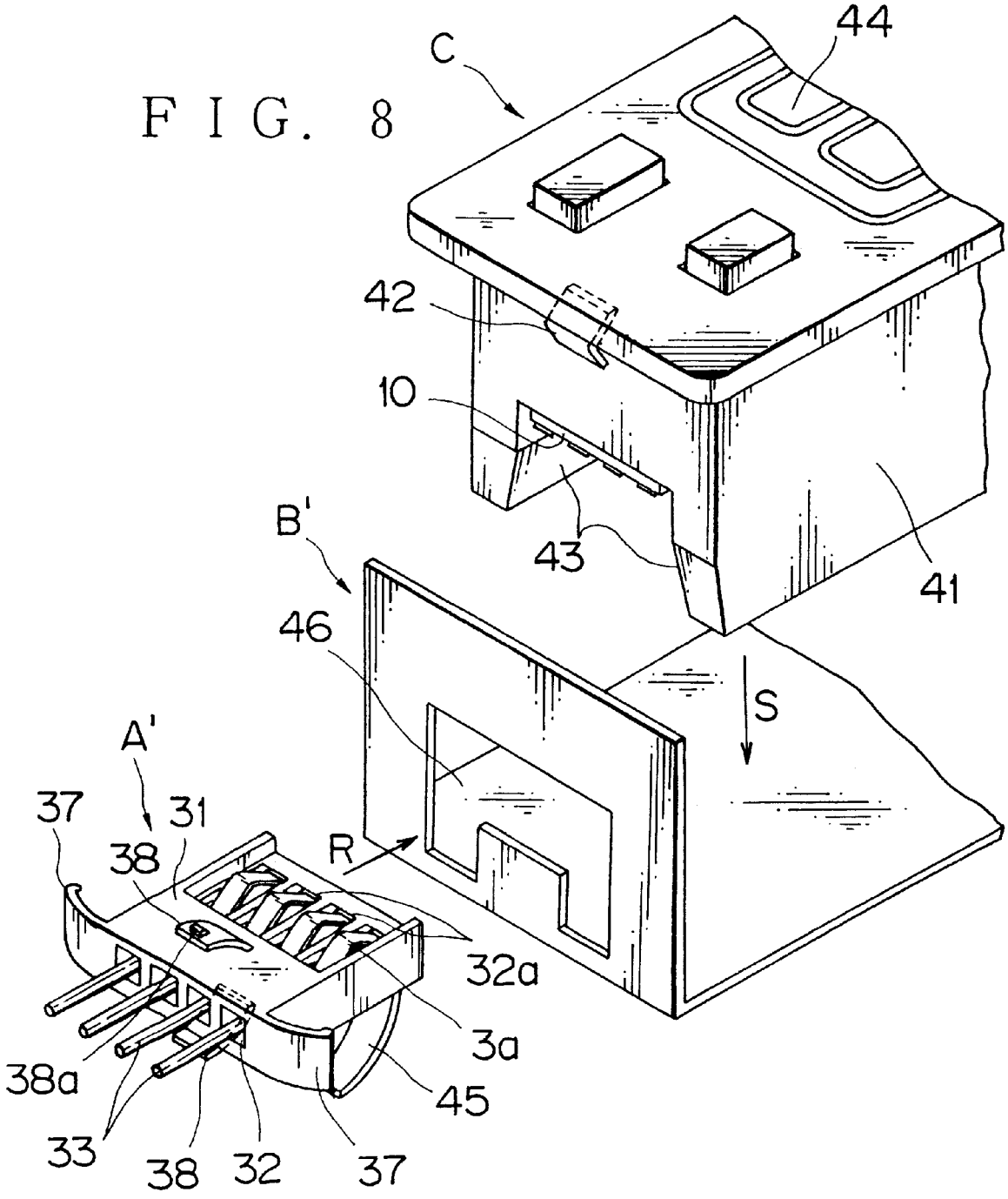
FIG. 8 is a perspective view showing another embodiment of the connector coupling structure of the present invention.
Figure 9:
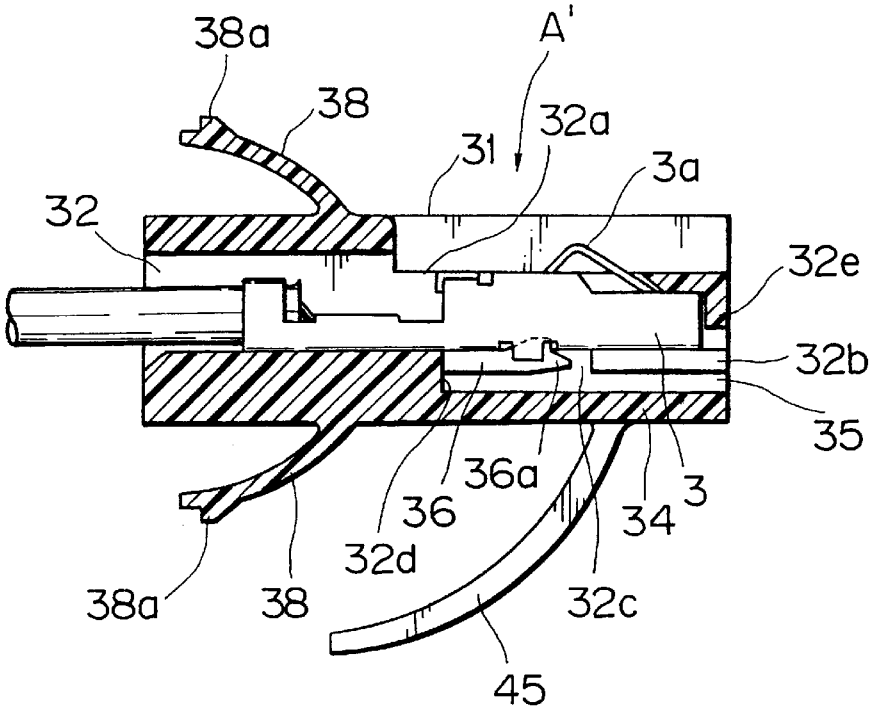
FIG. 9 is a sectional view of a connector in FIG. 8.

Referring to FIGS. 8–12, an explanation will be given of another embodiment of the connector coupling structure according to the present invention. FIG. 8 is a perspective view thereof. FIG. 9 is a sectional view of a connector of FIG. 8, in which the connector holding component B is not provided with the connector contact spring 40, but the connector A is provided with a connector holding arm serving as an elastic member.

In FIG. 8, element A' denotes a connector, element B' denotes a connector holding component into which the connector A' is to be inserted, and element C denotes an auxiliary device such as a switching unit or combination meter provided on the door trim as described above.

Referring to FIG. 9 also, unlike the above connector A, the connector A' is provided with a pair of connector holding arms 45 (only one is shown) opposed to each other on a bottom plate 34 of the connector housing 31.

The connector holding arm 45 is a metallic spring plate one end of which is integral to the lower face of the connector housing 31 and the other end of which is warped in a -shape rearward of the connector A'. Although not shown, the pair of connector holding arms 45 are arranged on both sides of the elastic securing piece 38. The connector holding arms 45 may be made of synthetic resin.

The connector holding component B, as seen from FIG. 8, is a frame or box having faces constituting an L-shape. The one face of the L-shape in a vertical direction has a connector insertion opening having an inverted concave shape so as to permit the connector holding arms 45 to pass. The other face of the L-shape in a horizontal direction is flat.

Now referring to FIGS. 10–12, with respect to the above configuration, an explanation will be given of an electric connection between each elastic contact piece 3*a* of the connector A' and the terminal connection strip 10*a*.

Figure 10:
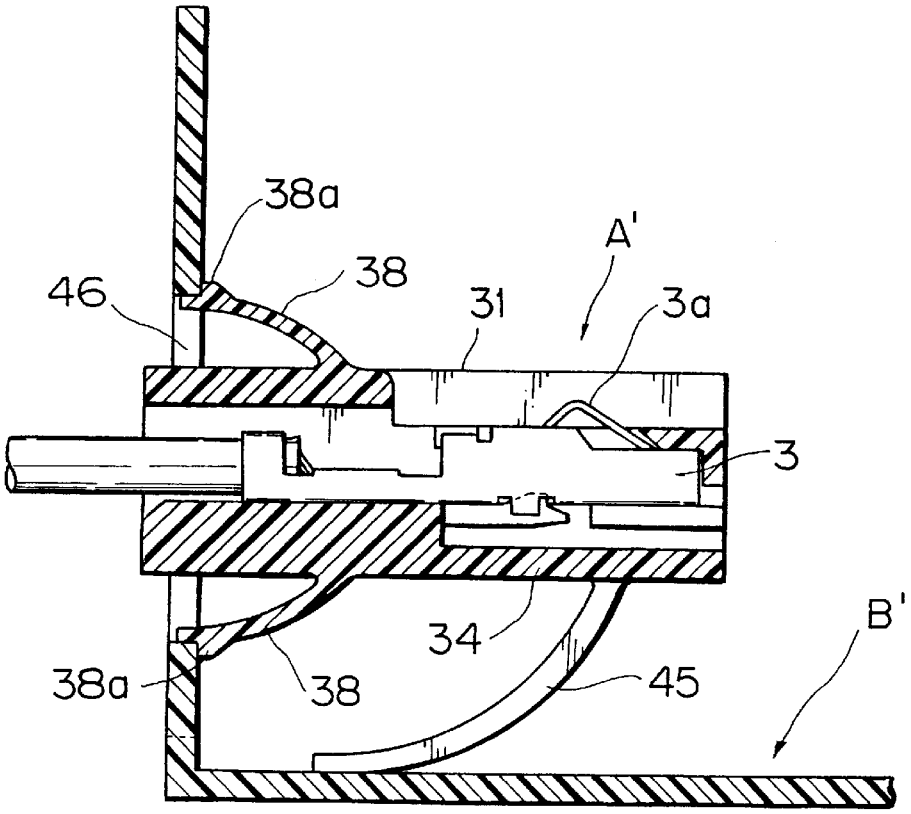
FIG. 10 is a sectional view showing the state where the connector has been inserted into the connector holding component.

In FIG. 10, with the elastic contact piece 3*a* of each terminal 3 located upward, the connector A' is inserted into the connector holding component B' in a direction of arrow R in FIG. 8. When the connector A' is inserted in the connector insertion opening 46, the pair of securing pieces 37 (see FIG. 8) is brought into contact with the one face of the connector holding component B', the respective securing areas 38*a* of the pair of elastic securing pieces 38 are engaged with the connector insertion opening 46, and the pair of connector holding arms 45 hold the connector A' in a parallel state to the other face of the connector holding component B'.

In this state, the securing pieces 37 and elastic securing pieces 38 limits movement of the connector A' in a direction of moving the connector A' in/from the connector holding component B' so that as shown in FIG. 5, the connector A' is firmly mounted in the door trim panel.

Figure 11:
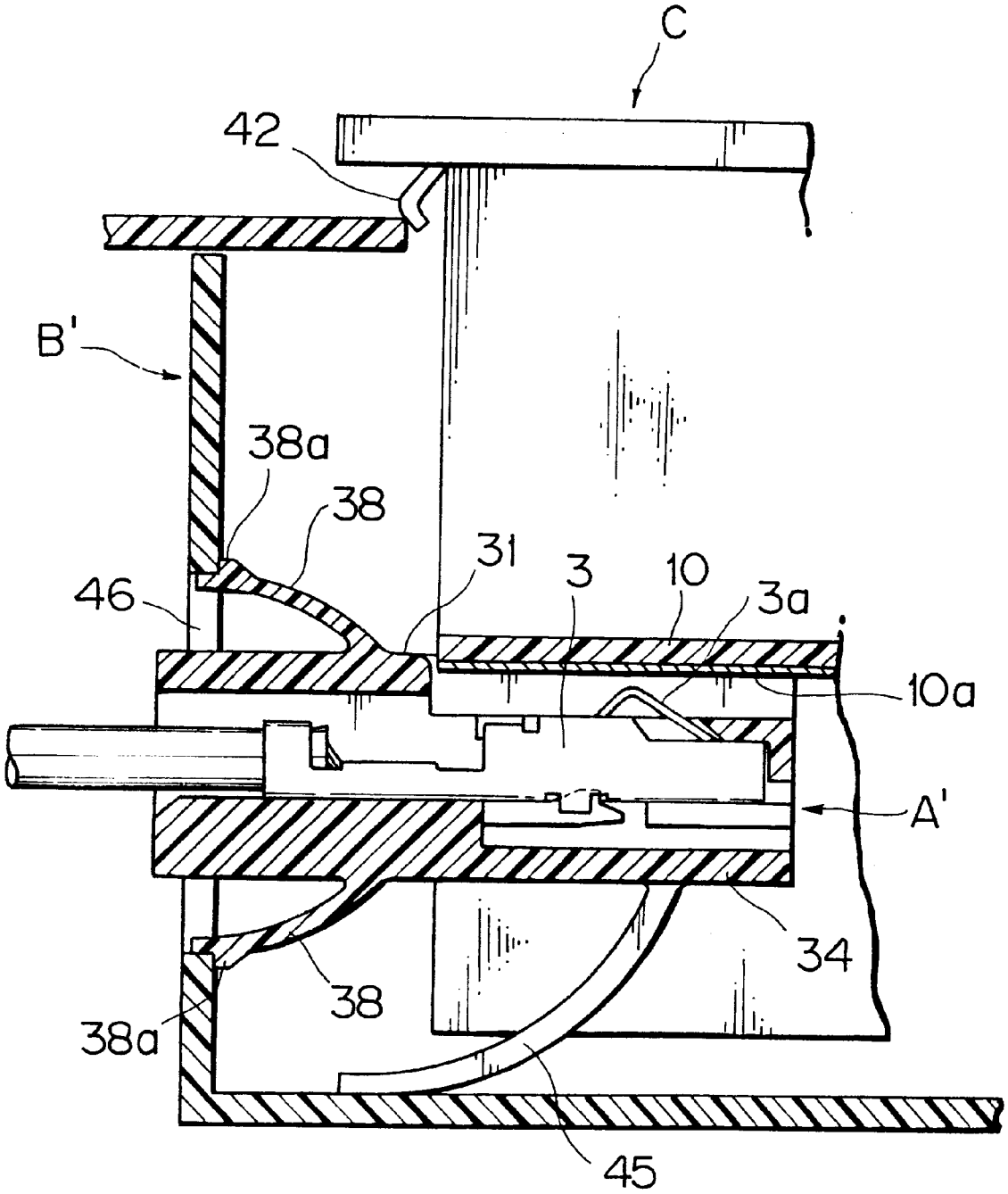
FIG. 11 is a sectional view for explaining the state of the elastic contact piece and terminal connecting strip on a printed board immediately before the auxiliary device of FIG. 8 is mounted in the connector holding component.

When the auxiliary device C is pushed into the door trim panel in a direction of arrow S in FIG. 8, as seen from FIG. 11, the locking member 42 is brought into contact with the edge of the door trim panel and the printed board 10 opposes to the elastic contact pieces 3*a* spaced apart therefrom. The printed board 10 may be brought into slight contact with the elastic contact piece 3*a*. Further, the connector A' is moved horizontally with respect to the direction of arrow R using the tapered areas 43 of the auxiliary device C so that precise alignment can be made between the connector A' and the printed board 10.

Figure 12:
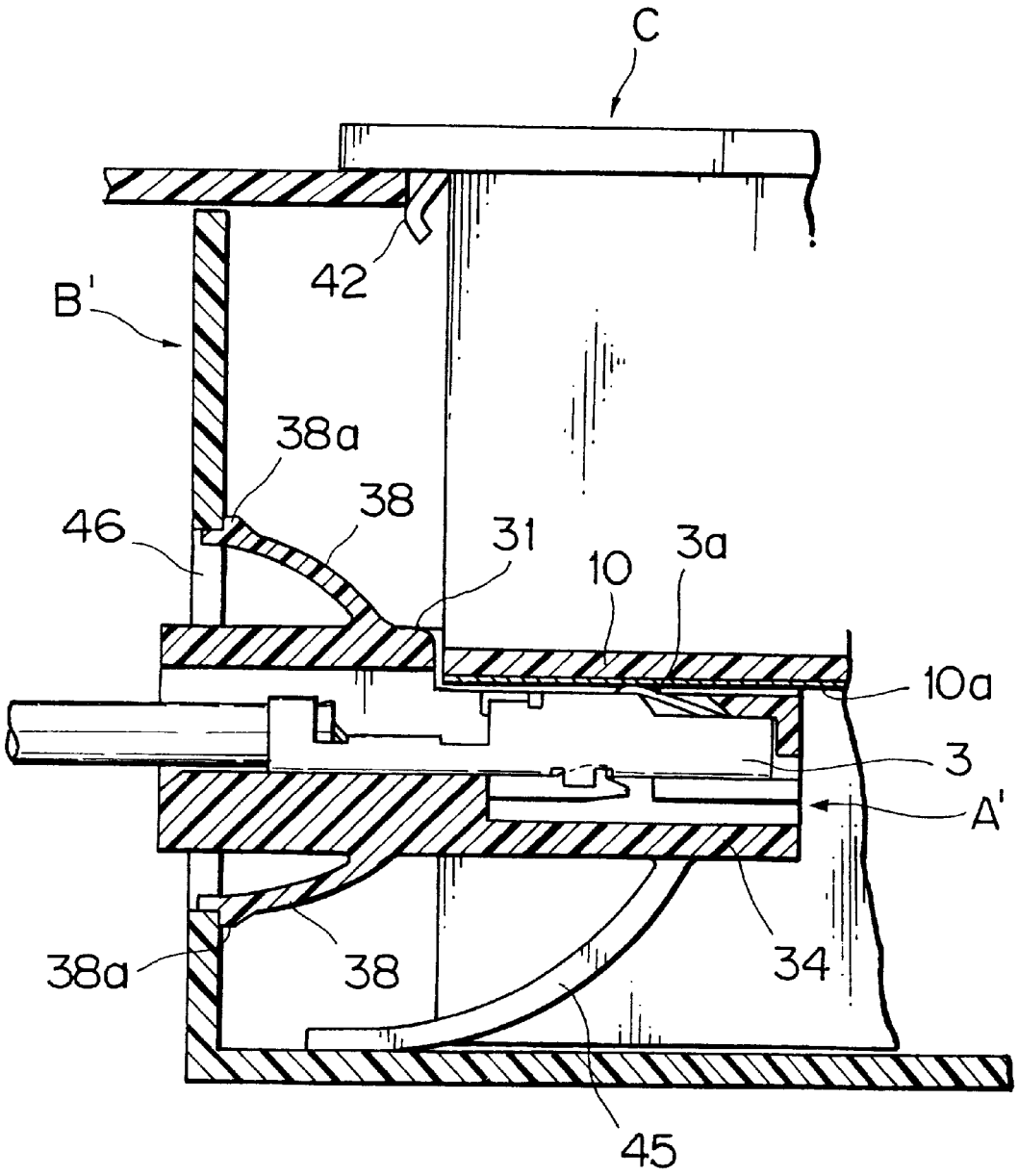
FIG. 12 is a sectional view showing the coupling state between the elastic contact piece of the terminal and terminal connection strip of the printed board.

When the auxiliary device C is further pushed into the connector holding component B, the locking member 42 is pressed against the edge of the door trim panel, and warps inwardly so that the auxiliary device C is secured on the door trim panel (see FIG. 12). Then, the force applied to mount the auxiliary device C pushes the connector A' downwards so that the connector A moves downward by an amount of locking of the locking member 42 together with the connector holding arms 45. The connector holding arms 45 intend to push back the connector A by its elastic force. Thus, the elastic contact piece 3*a* and the corresponding terminal connection area 10*a* of the printed board 10 are electrically connected to each other in a stable state.

As described above, in accordance with the connector coupling structure according to the present invention, the elastic contact pieces 3*a* of the terminals 3 and the terminal connection strips 10*a* of the printed board 10 are not electrically connected by mutual sliding, but by mutual pushing using small force applied to mount the auxiliary device C. Thus, the problems relative to the insertion force in connector coupling and deformation and damage of the elastic contact pieces and terminal connection strips can be solved, thereby improving the workability of connector coupling.

What is claimed is:

1. A connector coupling structure comprising:

a connector for a wire harness including a connector housing having an upper and a lower face and a plurality of terminal chambers, and a plurality of terminals equipped with elastic contact pieces, respectively, said elastic contact pieces being exposed from the upper face of said connector housing, respectively;

a printed board having a plurality of terminal connection strips formed on its surface and to be connected to said elastic contact pieces, respectively;

a connector holding component constituting an L-shape composed of a first face and a second face, said first face thereof having an opening for inserting said connector and said second face thereof being opposite to the lower face of said connector housing when said connector is inserted into the said connector holding component; and an elastic member arranged between said lower face of the connector housing and said second face of the connector holding component when the connector is inserted in the connector holding component, said elastic member being compressible in a direction perpendicular to a direction of inserting the connector in the connector holding component and a longitudinal direction of the second face of the connector holding component, wherein said printed board is pressed against the connector so that said elastic contact pieces are coupled with said terminal connection strips.

2. A connector coupling structure according to claim 1, wherein said compressible elastic component is a plate spring which is bent in a -shape at its intermediate area, attached to a corner of the L-shape of said connector holding component at its one end and floats from the second face of said connector holding component at its other end, said intermediate area being in contact with the second face of said connector.

3. A connector coupling structure according to claim 1, wherein said elastic member is a plate arm which is integrally attached to the lower face of said connector housing at its one end, and extends in a -shape to its other end, said other end being kept is contact with the second face of said connector holding component when the connector is inserted in the connector holding component.

4. A connector coupling structure according to claim 1, wherein said connector is provided with a pair of stoppers formed on the one side of the connector housing, and to be brought into contact with an edge of said opening when said connector is inserted into the connector holding component, and a pair of flexible pieces formed on said upper and lower faces of said connector housing and to be secured to the first face of said L-shape of the connector holding component.

5. A connector coupling structure according to claim 1, wherein said printed board is formed in an auxiliary device having a locking piece and to be attached to a door trim panel, wherein said printed board is brought into contact with said connector with the aid of said elastic member when said locking piece is locked with said door trim panel.

6. A connector coupling structure according to claim 5, wherein said connector holding component is formed integrally to said door trim panel.

7. A connector coupling structure according to claim 5, wherein said auxiliary device has a tapered area for alignment between said connector and said printed board.

* * * * *